US005740659A

United States Patent [19]

Cox et al.

[11] Patent Number: 5,740,659

[45] Date of Patent: Apr. 21, 1998

[54] SHRINK TUNNEL AND METHODS RELATING THERETO

[75] Inventors: John Farrell Cox, Drexel Hill; Frederick Henry Fiesser, Furlong; Robert Vincent Jeral, Philadelphia, all of Pa.; Donald Earl Erlston, Jr., Riverside; Richard Alan Hansen, Mt. Holly, both of N.J.

[73] Assignee: E. I. du Pont de Nemours and Company, Wilmington, Del.

[21] Appl. No.: 537,188

[22] Filed: Sep. 29, 1995

[51] Int. Cl.[6] ..... B65B 53/02

[52] U.S. Cl. ..... 53/442; 53/557; 53/216

[58] Field of Search ..... 34/203, 216, 217; 53/442, 557

[56] References Cited

U.S. PATENT DOCUMENTS

| | | | |
|---|---|---|---|
| 3,357,153 | 12/1967 | Shaffer | 53/442 |
| 3,578,747 | 5/1971 | Schramm | 34/184 |
| 3,591,767 | 7/1971 | Mudie | 219/354 |
| 3,668,817 | 6/1972 | Bell | 53/30 |
| 3,711,957 | 1/1973 | Carver, Jr. | 34/31 |
| 3,711,961 | 1/1973 | Spiegel et al. | 34/218 |
| 3,744,146 | 7/1973 | Nichols | 34/212 |
| 3,808,702 | 5/1974 | Laessig | 34/218 |
| 4,198,560 | 4/1980 | Dietrich | 219/388 |
| 4,204,379 | 5/1980 | Mognal et al. | 53/512 |
| 4,263,725 | 4/1981 | Ganz | 34/231 |
| 4,493,159 | 1/1985 | Schutz et al. | 34/43 |
| 5,062,217 | 11/1991 | Tolson | 34/216 X |
| 5,193,290 | 3/1993 | Tolson | 53/557 X |
| 5,339,605 | 8/1994 | Simpson, Sr. et al. | 53/439 |

FOREIGN PATENT DOCUMENTS

| | | | |
|---|---|---|---|
| 5085509 | 4/1993 | Japan | 53/557 |
| 715366 | 9/1954 | United Kingdom | 53/442 |
| 2079716 | 1/1982 | United Kingdom | 53/557 |
| 2119341 | 11/1993 | United Kingdom | 53/557 |

*Primary Examiner*—Linda Johnson

[57] ABSTRACT

An apparatus for shrinking a heat-shrinkable film around a product. The apparatus has a first heating stage which heats a portion of the underside of the package to properly position the shrink film and a second heating stage which further shrinks the film. Side heating jets can optionally be used to heat the sides of the package between the first and second heating stages. The top of the package can also be heated after the second heating stage.

10 Claims, 1 Drawing Sheet

SHRINK TUNNEL AND METHODS RELATING THERETO

BACKGROUND OF THE INVENTION

1. Field of the Invention

The present invention is directed to an improved multi-step shrink tunnel design which is capable of providing controlled shrinkage during high speed, steady state operation, while also providing improved energy efficiency, operability and reliability. More specifically, the shrink tunnels of the present invention provide a preliminary heating step (which partially shrinks a portion of the underside of the shrink film for proper preliminary positioning of the film) prior to a second, more comprehensive, primary heating step. The shrink tunnel design of the present invention is capable of providing a final product which is tightly wrapped in shrink film and is much more marketable, since the final product: a) is generally without unsightly balls of shrunken film along the corners, b) typically has seam(s) properly hidden under the package, and c) generally has a print pattern which is reliably and properly displayed on top of the package.

2. Discussion of the Prior Art

Broadly speaking, shrink films are well known. Such films are generally heated, stretched in a solid state and thereafter cooled, causing the film to remain in an oriented state at typical ambient temperatures. The shrink film is generally wrapped around a product and thereafter heated. Once sufficient heat is applied to the film, the film will typically endeavor to shrink to its unoriented state, thereby causing the shrink film to tightly wrap around the product.

Shrink tunnels in general are also well known. Such devices are used to heat the shrink film, after the shrink film has been applied around a product. Conventional shrink tunnel designs have typically used heated air and/or water in a substantially single (shrink) step design. Conventional shrink tunnels have had shortcomings however.

Conventional shrink tunnels generally do not provide controlled film shrinkage. Hence, the printed portion of the film may shrink in a way which makes the print difficult to read or otherwise detracts from the appearance of the package. Without controlled shrinkage, a seam can sometimes occur on a highly visible portion of the package, and this can also detract from the appearance of the package. Furthermore, shrink tunnels can be slow, energy inefficient, prone to breakdown or failure and can be difficult to operate.

SUMMARY OF THE INVENTION

Overview

The shrink tunnels of the present invention are designed to accept products loosely packaged in (unshrunk) shrink film. Preferably, the shrink film is wrapped around the product and sealed along the bottom, and in addition, the front and back film openings are also preferably sealed. Generally, a vacuum is drawn as the final seal is made, so the film envelops the package without entrapping a significant amount of air. The product is thereby hermetically sealed within a lose package of shrink film. The loosely wrapped product can then be conveyed through the shrink tunnel of the present invention, which heats the shrink film, causing it to tightly shrink around the product.

The shrink tunnel design of the present invention applies heat (in a series of steps) to the incoming packages, preferably using a heated liquid. Heated liquids, particularly water, are preferred, because the temperature of liquids can generally be controlled more accurately on an industrial scale as compared to heated gases. Furthermore, liquids generally have a higher capacity for heat transfer than gases.

Shrink film shrinkage generally occurs within a broad temperature range. At the lower portion of the temperature range, the film generally shrinks less than at higher regions of the temperature range. By using a heated liquid, a desired temperature can be maintained which in turn provides the proper or desired amount of film shrinkage for the particular film and packaging configuration.

The heat is applied to the shrink film, using at least two separate heat application steps: a) first, the preliminary shrink step, and b) then, the primary shrink step. The two shrink steps will first be described separately. Thereafter, optional additional features and preferred process configurations will be described.

Preliminary Shrink Step

The preliminary shrink step applies heat to an underside portion (of the wrapped product) which is a distance (at least about a centimeter or more) from the front edge of the product, thereby causing partial shrinkage under the package. This partial shrinkage generally pulls the front and rear seals downward toward the bottom of the package. Upon final film shrinkage then, the seams will generally be less noticeable, particularly when viewing the package as it would be displayed in a store. The preliminary shrink step also diminishes film slackness from the top portion of the package.

It has been advantageously found that this underneath shrinkage can pull film over protrusions and sharp edges and downward from the sides and top of the package. Thereafter, when the primary shrink step is conducted, the top portion of the package has an improved, clean appearance. Due to the two step shrink procedure, any unsightly bunching or agglomerations of shrunken film will generally occur away from the top portion of the package.

The design of the present invention is particularly advantageous, when the product to be packaged includes a tray, rigid container or otherwise defines at least one rigid or sharp corner or protrusion at the beginning portion of the product as it moves through the shrink tunnel. The shrink film will tend to tighten and slide over each protrusion during the preliminary shrink step. The preliminary shrink step generally ensures that the film does not lock on the corners or protrusions of the product; otherwise upon final film shrinkage: 1. an unsightly glob of shrunken film could occur at the corners or protrusions; or 2. the lower seams could be pulled upward to a more noticeable package location.

The Primary Shrink Step

After the first (preliminary) step, the wrapped package is conveyed to a second (primary) step, where the package is heated along at least the bottom ten percent of the package. Preferably the primary shrink step is accomplished by moving the package, at least partially submerged, through a heated liquid bath. Preferably, the top surface is not submerged within the bath, so that the ends and bottom portion of the shrink wrap are shrunk, while the top surface of the shrink film is only partially shrunk (or not shrunk at all).

In this way, the shrink film is tightly shrunk around the package, but the seams are generally hidden under the package. Furthermore, the printing on top of the package is generally not overly distorted by the shrink operation, since only limited, if any, shrinkage generally occurs at the top surface of the shrink film wrap. The bath is preferably heated to a temperature which will cause the shrink film to shrink along at least the bottom portion (and preferably also a portion of the side) of the package.

Optional Components

Before the primary shrink step and preferably between the preliminary and primary shrink steps discussed above, a pair of side nozzles are preferably also used, whereby heated liquid flows from the side nozzles and contacts the front and side portions of the wrapped package as the package moves through the shrink tunnel. The side streams of heated liquid cause film shrinkage which removes slackness from the girth of the package and also generally causes the end seals of the package to move downward and thereby provide a more visually appealing package.

In a preferred embodiment, the packages exit the primary shrink step (e.g., water bath) along a shallow incline, where a flow of hot water is sprayed onto the top of each package as it leaves the shrink tunnel. This final application of hot water generally smoothes out any remaining loose areas of the film. Thereafter, the packaged product exits the shrink tunnel.

Also, a fan, a (positive or negative pressure) air amplifier or a similar-type device can be used to flow ambient (or cooled) air over the packages as they move through the shrink tunnel, thereby inhibiting unwanted film shrinkage due to heated, stagnate air within the shrink tunnel.

BRIEF DESCRIPTION OF THE DRAWING(S)

FIG. 1 is a cut-away side view of the preferred shrink tunnel in accordance with the present invention.

DETAILED DESCRIPTION OF THE PREFERRED EMBODIMENT(S)

Figure 1:
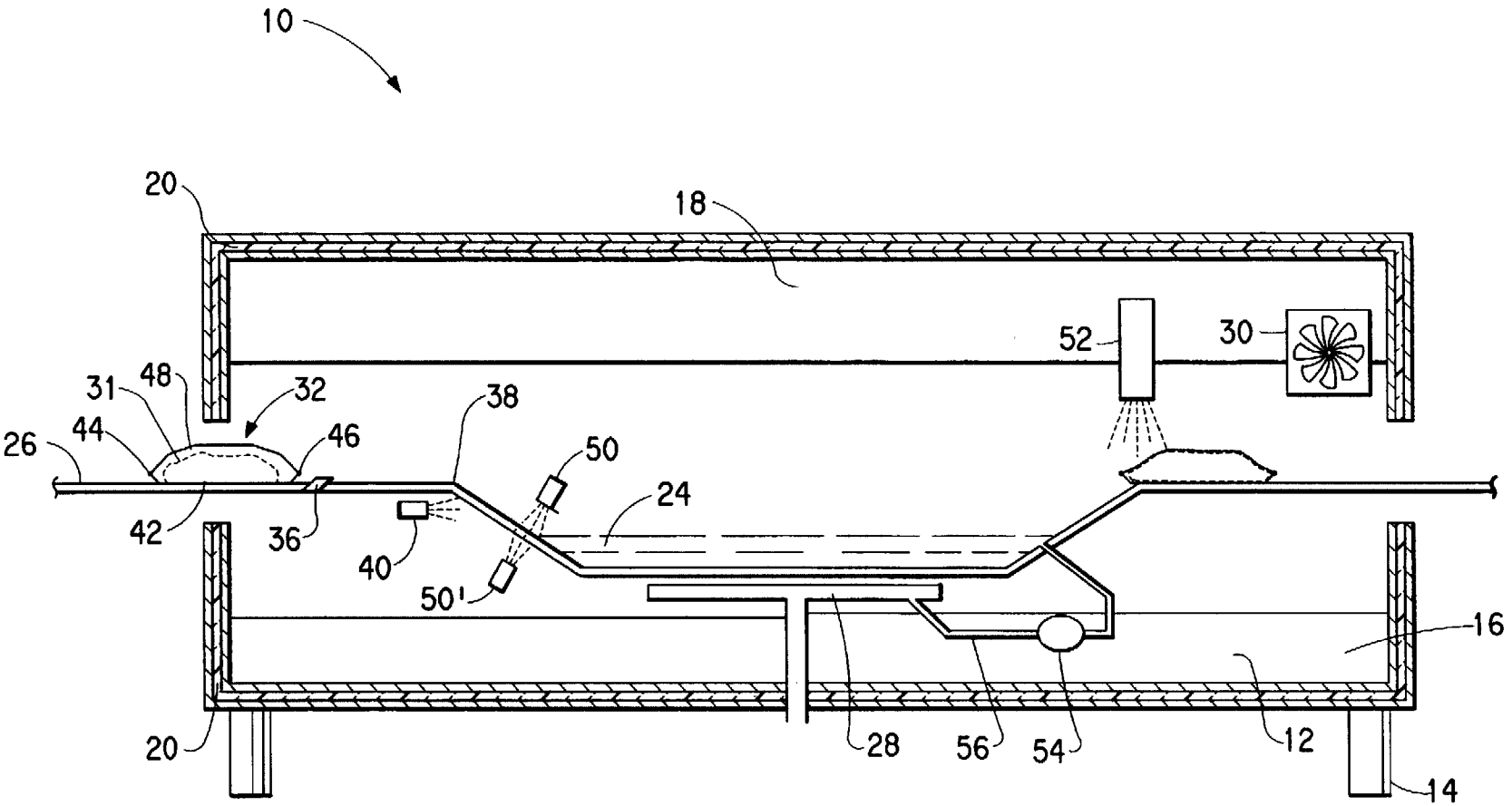

The preferred shrink tunnel is shown generally at 10 in FIG. 1 and has a stainless steel base structure 12, including a welded tubular frame 14. Preferably, the sides 16 and top 18 have a layer of thermal insulation 20 between inner and outer sheets of metal. The thermal insulation not only increases the thermal efficiency of the unit, but also, improves safety by lowering the temperature of the outer surface.

The preferred shrink tunnel receives product 31 which is loosely wrapped in (unshrunk) shrink film 48 onto a wire mesh conveyor belt 26. The shrink film 48 has a bottom seal 42 along the bottom of the package (in the machine direction) to form a tube, and the shrink film also has a front seal 46 (in the traverse direction) and a back seal 44 (also in the traverse direction) to completely enclose the product and thereby form a package 32. The shrink tunnel is then used to shrink the shrink film around the product as follows.

The packages 32 pass through a set of adjustable metal guides 36 which position the packages squarely at the center of the wire mesh conveyor 26. The conveyor 26 moves each package over an apex 38, and as the package pivots over the apex, a bottom portion of each package contacts a stream of hot water from a substantially horizontal first nozzle 40. The front (underside) portion of the package pivots over the first nozzle without contacting the heated water flowing from the first nozzle. As the packages move past the first nozzle, the sides of each package are sprayed with hot water by opposing side nozzles 50 and 50'.

Heat transfer from the first nozzle 40 pulls excess film from the top of the package. The first nozzle also pulls front seal 46 and back seal 44 downward, thereby making the unsightly front and rear seals less observable to the consumer. Heat transfer from the side nozzles shrinks the front and rear seals and also removes slackness from the girth.

Preferably during this initial shrink step, ambient (or cooled) air is caused to flow over the top of the package, such as by means of fan 30, thereby ensuring that the initial shrinkage occurs under the package. Fan 30 moves the hot moist air (emanating from the hot water system) through the ducts of the shrink tunnel and also maintains a flow of ambient air through the shrink tunnel. In this way, the packages (or portions thereof) are kept sufficiently cool to inhibit shrinkage until contacted with heated water. The air flow is preferably greater than about 5 feet per minute, more preferably greater than about 50 feet per minute and most preferably greater than about 75 feet per minute.

The conveyance of the package can be conducted by a conventional conveyor belt, such as those made from rubber, metal mesh, cloth, or the like. Preferred such belts have openings, so the heated water flowing from the first nozzle can flow through the belt and contact the underside of the package as an underside portion of the package moves past the first nozzle. The conveyor system is preferably a wire mesh belt on which packages are borne as they are moved through the machine. The drive system preferably comprises a conventional electric motor drive, complete with a variable-speed controller, belt-tensioning wheels, drive shaft, and the like. The conveyor should provide lateral stiffness, while being free to follow the upward and downward incline.

Alternatively, the package can be conveyed pneumatically, electronically or otherwise. The particular conveyance method is not critical, and if a conveyor belt is used, it is not critical that the conveyor have any particular path or configuration. Rather, what is critical is that at least a portion of the underside of the package be heat shrunk, before a more comprehensive heat shrink of the film is undertaken. Most preferably, only the middle underside portion is heat shrunk first.

After the initial or preliminary shrink step, the conveyor then preferably moves the packages into the hot bath reservoir 24 in which water is uniformly heated by a dense steam coil 28. Preferably, the front edge of the package enters the reservoir first, thereby beginning the primary shrink process from the front edge, causing the front portion of the package to tighten first. A steam coil is preferably used to maintain constant temperature within the bath. In a preferred embodiment, the steam coil configuration forms a plane within the water, just below (and parallel to) the conveyor path which moves the packages through the bath. The tubes of the steam coil should preferably be packed tightly together, so the water is heated uniformly along the bottom of the bath.

In a preferred embodiment, the reservoir fluid is water. Preferably, salt is added to the water to increase its boiling point. Preferably the water is heated to a temperature of about its boiling point. Preferably, the water bath is kept at a substantially constant temperature, so shrinkage along the bottom and sides of the package is substantially uniform. The packages move through the water reservoir about half submerged (the preferred range is about 10% to 100%, more preferably about 20% to about 90% submerged). During this step, at least a lower portion of the shrink film package is fully shrunk.

As the packages then move out of the hot water reservoir 24 by means of the wire mesh conveyor 26, the packages move along a slight incline. An upper rear nozzle 52 flows hot water onto the tops of the packages. This final application of hot water often smoothes out any remaining loose areas of the shrink film.

The conveyor then continues to move the finished packages either to an output tray, where the finished products are taken directly from the tray by an operator, or the finished packages are permitted to fall into an accumulation bin.

Preferably, as heat transfer from the steam coil causes condensation to occur within the steam coil, a conventional condensate trap 54 is used to remove the condensate from the steam coil, and this condensate is transferred directly into the bath through make-up water line 56. In this way, make-up water is at substantially the same temperature as the bath, and uniform bath temperature is maintained, even as water is replaced, due to water loss due to evaporation, accumulation on the package as it exits the bath or the like.

Alternatively, liquid heating could be accomplished by methods other than a steam coil. Other heating methods could be used, such as electric resistance heating, electromagnetic heating (i.e., infra-red heating), flame or other conventional or non-conventional heating source. The liquid heating source is generally not critical, but rather, the critical aspect of the second or primary shrink step is that the underside and preferably at least a portion of the sides are fully shrunk ("fully shrunk" is not intended to be the absolute theoretical shrinkage limit, but rather, broadly speaking, about the amount of readily observable shrinkage as dictated by the type of film, tauntness of the wrap, shrinkage temperature and exposure rate within the design specifications of the particular shrink system being used).

The preferred shrink tunnel can also be described as comprising four separate systems:

a) a water system which accepts water from an outside water supply line, maintains a reservoir 24 of hot water through which packages move partially submerged and from which hot water is pumped for spraying on selected parts of the packages as they move through the shrink tunnel;

b) a conveyor system 26 which moves packages through the shrink tunnel on a stiff wire surface that permits water contact through partial immersion and permits spraying of the packages as they move along the conveyor path;

c) a steam system which is used to heat the water through heat-exchanger coils 28 positioned in the water reservoir 24; and d) an electrical system which supplies power required for operations, such as, moving the conveyor, pumping water, and operating fan 30.

The water system is preferably designed to maintain a selected water depth within the reservoir 24 so that the packages 32 are only partially submerged as they are transported by the conveyor 26 through the reservoir. The water level can be maintained by a float assembly which activates a water supply valve at the minimum water level and de-activates the water supply valve at a maximum water level.

Alternatively or in addition, an estimated amount of water can be automatically added to the system. To prevent the water level from exceeding a maximum, a vertical tube can be used which is connected to a drain and which comprises a drain hole at a particular height. Preferably, this tube can be adjusted up or down to modify the desired maximum height.

Water from the tank is gravity-fed to a pump which forces the water through the nozzles 40, 50, 50' and 52 that spray hot water onto the packages during their travel through the machine.

What is claimed is:

1. An apparatus for processing a product and heat shrinkable film combination, the combination comprising: i. a product having a top surface, a side surface, and a bottom surface, the bottom surface further defining a front edge and a rear edge; ii. a heat shrinkable film which wraps around the top surface, the side surface and the bottom surface of the product and iii. optionally, a support which supports the product and which is located substantially between the product and the heat shrinkable film, the combination being processed by shrinking the heat-shrinkable film around at least a portion of the product as the combination comprising the product and the heat-shrinkable film moves through the apparatus, said apparatus comprising:

a transportation mechanism for moving the product and heat-shrinkable film combination through the apparatus, the transportation mechanism causing the product and heat shrinkable film combination to move along a path having a beginning portion and an end portion;

a first heat applicator means for applying heat to only an underside portion of the bottom surface of the product, the bottom surface portion being a distance from the front edge of the product of from about one tenth to about nine tenths of a package length, the package length being defined as the distance between the front edge and the rear edge of the bottom surface of the product, the first heat applicator being located along the beginning portion of the path of the product and heat-shrinkable film combination, the first heat applicator causing the heat-shrinkable film located substantially adjacent to the underside portion of the product to shrink, so at least a portion of the heat-shrinkable film moves from the top and the side of the product toward the bottom of the product;

a second heat applicator for applying heat along at least a portion of the bottom and a portion of the sides of the product as the product moves along the end portion of the transportation mechanism, the second heat applicator being downstream from the first heat applicator, and the second heat applicator causing the shrink film to shrink further around at least a portion of the product.

2. An apparatus in accordance with claim 1, wherein the first heat applicator comprises a nozzle from which a heated liquid flows, the liquid being heated to at least a minimum shrink temperature of the heat-shrinkable film, and the second heat applicator is a reservoir of a heated liquid into which the product and shrink film combination is partially or wholly immersed, the liquid of the reservoir being heated to at least a minimum shrink temperature of the shrink film.

3. An apparatus in accordance with claim 1, wherein a portion of the path of the transportation mechanism descends, thereby creating an apex and a descending path and thereafter ascends, thereby creating an ascending path, and wherein the transportation mechanism carries the product and pivots the product over the apex, wherein as the product pivots over the apex to the descending path, the first heat applicator causes the shrink film substantially adjacent to the underside portion of the bottom surface of the product to shrink.

4. An apparatus in accordance with claim 3 wherein the transportation mechanism moves the product and shrink film combination out of the reservoir, along the ascending path.

5. An apparatus in accordance with claim 2, wherein the reservoir is heated by a conduit containing steam and as the steam condenses into a condensate, the condensate is captured and released into the reservoir to provide a make-up water source.

6. An apparatus in accordance with claim 1 further comprising a side nozzle which sprays heated liquid onto a side of the package prior to the package being heated by the second heat applicator.

7. An apparatus in accordance with claim 6, wherein a flow of heated fluid contacts the top of the package after the package is heated by the second heat applicator.

8. A continuous, in-line process for heat shrinking a shrink film around an article having a front edge and a rear edge and a bottom surface comprising:

moving the article wrapped with shrink film toward an apex, pivoting the article wrapped with shrink film over the apex, heating only an underside portion of the bottom surface of the article, the bottom surface portion being a distance from the front edge of the article of from about one tenth to about nine tenths of a package length, the package length being defined as the distance between the front edge and the rear edge of the bottom surface of the article, said heating of the underside portion occurring as the article pivots over the apex, and thereafter moving the article into and through a heated liquid bath.

9. A process in accordance with claim 8 further comprising: heating a side of the shrink film after the shrink film pivots over the apex and before the shrink film moves through the heated liquid bath.

10. A process in accordance with claim 9 further comprising: heating a top portion of the shrink film after it moves through the heated liquid bath.

* * * * *